United States Patent [19]

Misson et al.

[11] 4,000,389

[45] Dec. 28, 1976

[54] PRINTED CIRCUIT BOARD AND CONTACT ASSEMBLY FOR KEYBOARD SWITCH ASSEMBLIES

[75] Inventors: William W. Misson, Santa Rosa; Clarence K. Studley; William J. West, both of Los Altos; Edward T. Liljenwall, Sunnyvale, all of Calif.

[73] Assignee: Hewlett-Packard Company, Palo Alto, Calif.

[22] Filed: Feb. 14, 1975

[21] Appl. No.: 550,060

Related U.S. Application Data

[62] Division of Ser. No. 173,754, Aug. 23, 1971, Pat. No. 3,941,953.

[52] U.S. Cl. ..... 200/292; 200/159 R; 200/239

[51] Int. Cl.[2] ..... H01H 9/00; H01H 1/14; H01H 13/52

[58] Field of Search ..... 200/5 R, 5 A, 159 B, 200/275, 279, 237–251, 340, 292

[56] References Cited

UNITED STATES PATENTS

| | | | |
|---|---|---|---|
| 3,742,157 | 6/1973 | Leposauic | 200/159 B X |
| 3,796,843 | 3/1974 | Durkee et al. | 200/279 X |
| 3,941,953 | 3/1976 | Misson et al. | 200/159 B X |

*Primary Examiner*—James R. Scott
*Attorney, Agent, or Firm*—Patrick J. Barrett

[57] ABSTRACT

A keyboard is disclosed comprising a printed circuit board having conductors on only one side. Resilient switching elements are supported by selected ones of the conductors and may be deflected into contact with other selected ones of the conductors by keys supported above the switching elements.

3 Claims, 14 Drawing Figures

PRINTED CIRCUIT BOARD AND CONTACT ASSEMBLY FOR KEYBOARD SWITCH ASSEMBLIES

Cross Reference To Related Application

This application is a division of application Ser. No. 173,754, filed Aug. 23, 1971, now U.S. Pat. No. 3,941,953.

BACKGROUND OF THE INVENTION

Prior art keyboards may be divided into two categories: those which provide tactile feedback and those which do not. The switching mechanisms in prior art keyboards providing tactile feedback are relatively bulky and often mechanically complex. Some of that complexity is due to the use of separate mechanisms for the tactile feedback function and for the switching function. Many of the keyboards not providing tactile feedback are relatively compact, but suffer the disadvantage that the user is never sure if he has depressed a key sufficiently to close the switch. Some of these non-feedback type keyboards comprise two arrays of conductors separated by a small air space. When the user depresses a key, one of the conductors, an elastic member, is pressed against another conductor to make an electrical connection. Examples of both of these types of keyboards are shown in an article entitled "Keyswitches and Keyboards," EEE Magazine, pp. 64–73, November 1970.

SUMMARY OF THE INVENTION

The present invention comprises a keyboard in which the same physical elements perform the switching function and the tactile feedback function. An array of conductors is supported on a substrate such as a printed circuit board, and an array of metallic strips is supported over the array of conductors, with an air space between the two arrays. Each metal strip is curved about an axis lying in the plane of the substrate and a key is supported above each intersection of the arrays of conductors and metal strips. When a user depresses a key, it deflects a corresponding portion of a metal strip toward one of the array of conductors to make a switch closure. As the metal strip is deflected, it abruptly snaps or buckles, as the curvature is changed to give tactile feedback to the user. The snapping action results in a decrease in the resilience of the metal strip, which insures that the strip will be pressed against the corresponding one of the array of conductors. Thus, the tactile feedback assures the user that the key has been depressed sufficiently to close the switch.

DESCRIPTION OF THE PREFERRED EMBODIMENTS

Figure 1:
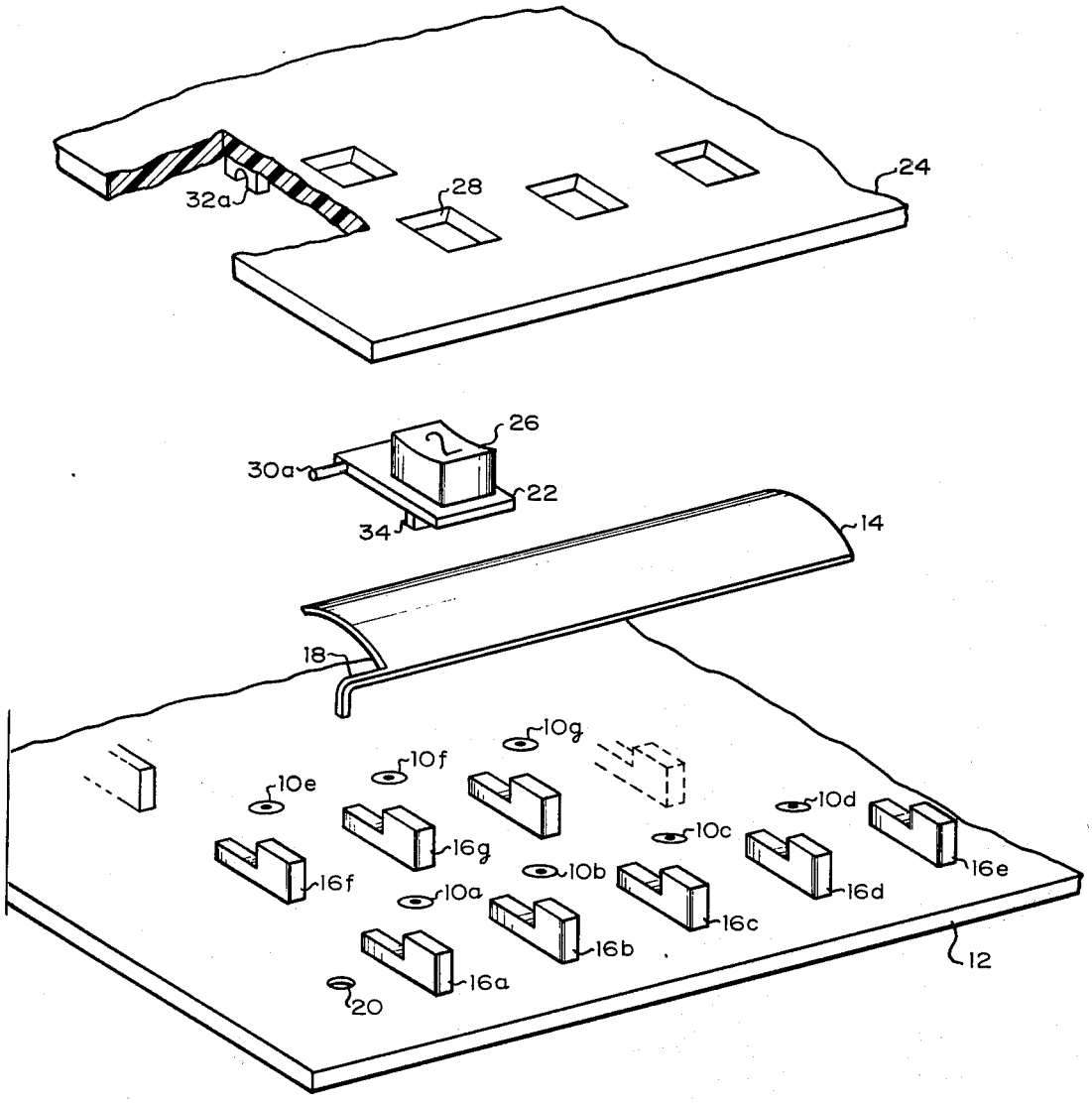
FIG. 1 shows an exploded perspective view of one preferred embodiment of the present invention.
Figure 2A:
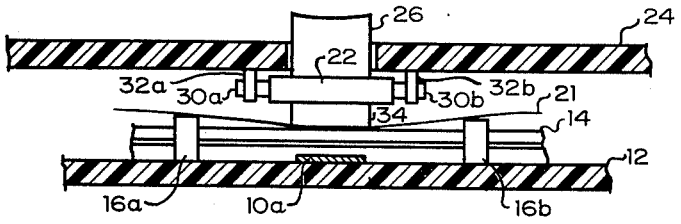
FIGS. 2 a–c show cutaway side views of the device of FIG. 1.
Figure 2B:
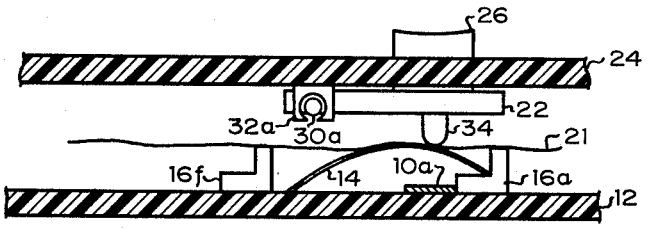

One of the preferred embodiments of the present invention is shown in FIGS. 1 and 2 *a–c*. An array of conductors 10 is supported on a rigid substrate 12, which may comprise an etched printed circuit board, for example. Each conductor 10 forms one contact of a switch. Wires or printed circuit conductors may attach to each conductor 10 from the underside of substrate 12. A curved conductive strip 14, made of beryllium-copper, for example, is supported above each row of conductors (e.g. conductors 10*a* – 10*d*) by a series of insulating supports 16. Each conductor has an insulating support on either side of it, as, for example, conductor 10a has insulating supports 16a and 16b beside it. A tab 18 on strip 14 fits into a hole 20 in substrate 12 to retain strip 14 and also to provide an electrical connection with it. Alternate means can also be used to retain and make contact to strip 14, such as insulative blocks fastened to substrate 12 at each end of strip 14 and a conductor on substrate 12 under one edge of strip 14. As can be seen from FIG. 2*b*, insulating supports 16 also act as retainers for strip 14. Also illustrated in FIGS. 2*a* and 2*b* is a thin plastic membrane 21 which protects the conductors from contamination such as dust. Membrane 21 is omitted from subsequent figures for the sake of clarity.

A key 22 is supported over each conductor 10 by a support member 24, and a button portion 26 of key 22 projects through a hole 28 in the support member. Shafts 30*a* and 30*b* on key 22 are rotatably mounted in journals 32*a* and 32*b* to constrain the key to move in an approximately up and down fashion. A protrusion 34 on key 22 rests on strip 14, and thus the strip holds the key in its up position. This description of key 22 is offered as just an example since other key embodiments are possible.

Figure 2C:
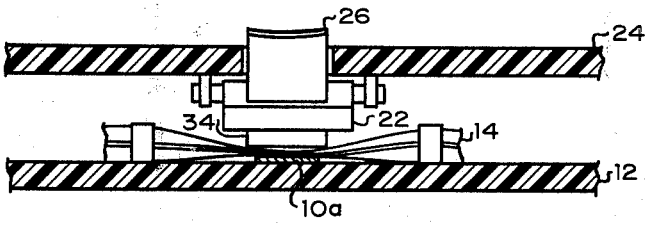

When a user depresses key 22, protrusion 34 deflects strip 14 toward conductor 10*a* as illustrated in FIG. 2*c*. Strip 14 acts as a spring and thus offers increasing resistance as the key is depressed. However, after the strip has been deflected part way toward conductor 10*a*, the curvature of the strip will flatten out and the resilience of the strip will decrease abruptly. The user will feel the strip snap and the decrease in resilience will insure that the key is depressed completely to make electrical contact between strip 14 and conductor 10*a*, as shown in FIG. 2c. This action is illustrated in the force - deflection curve of FIG. 3. At inflection point 50 the resilience of the strip abruptly changes and it then decreases with further deflection until inflection point 52 is reached. At this second inflection point the resilience of the strip again changes. It is desirable that strip 14 make electrical contact with conductor 10*a* at some point on the force-deflection curve between points 50 and 52. When the user releases key 22, strip 14 will snap back to its curved configuration and will return the key to its up position. It is desired that the electrical contact also break between points 50 and 52 on the force-deflection curve. Such a relationship between the strip resilience and the making and breaking of electrical contact insures that the user will receive the tactile feedback at the appropriate time.

The amount of tactile feedback to the user depends on the abruptness in the change in resilience of strip 14. That abruptness is determined, inter alia, by the length and shape of protrusion 34, the spacing between insulating supports 16, the width and curvature of strip 14, and the amount of restraint on the ends of strip 14, such as at tab 18. If the change in resilience is very abrupt, the user will hear it as an audible click as well as feel it. The abruptness may be increased, for example, by making protrusion 34 shorter and more pointed, or by decreasing the space between insulating supports 16. However, it is believed that the life of strip 14 is reduced by increasing the abruptness of the change in resilience. Therefore, the amount of tactile feedback provided by a key must be traded off against such considerations as life of the switching element.

Figure 3:
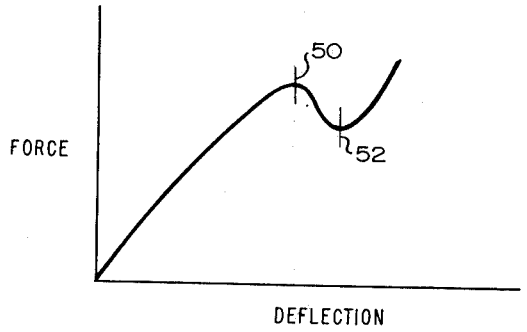
FIG. 3 shows a force-deflection curve for a key switch having tactile feedback.
Figure 4:
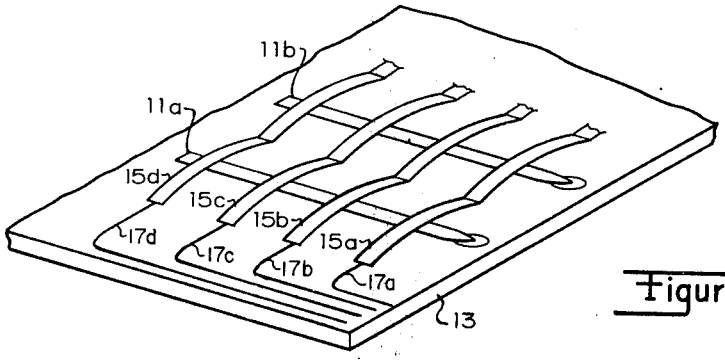
FIG. 4 shows a perspective view of a portion of another preferred embodiment.
Figure 5A:
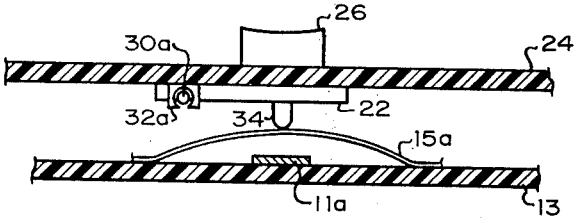
FIGS. 5 *a–b* show cutaway side views of the device of FIG. 4.
Figure 5B:
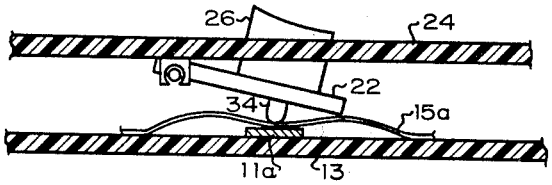

A second preferred embodiment is shown in FIGS. 4 and 5 *a–b*. Conductors 11 are supported on a substrate 13 and curved strips 15 arch over conductors 11. Strips 15 are fastened to substrate 13 on either side of each conductor 11 by soldering, for example. As above, a conductor, such as conductors 17*a*–17*d*, is connected to each strip 15. As illustrated in FIG. 5*a*, key 22 is held in the up position by a strip 15*a*. When key 22 is depressed, strip 15*a* is deflected toward conductor 11*a*. The strip offers increasing resistance to the key as the key is depressed until the strip snaps or buckles with a change in curvature. At that point, the resilience of the strip abruptly decreases insuring that the user will completely depress the key to make an electrical contact between metal strip 15*a* and conductor 11*a* as shown in FIG. 5*b*. This action is illustrated in FIG. 3, as discussed above. When the user releases the key, the strip will snap back to its arched configuration and will return the key to its up position.

Figure 6:
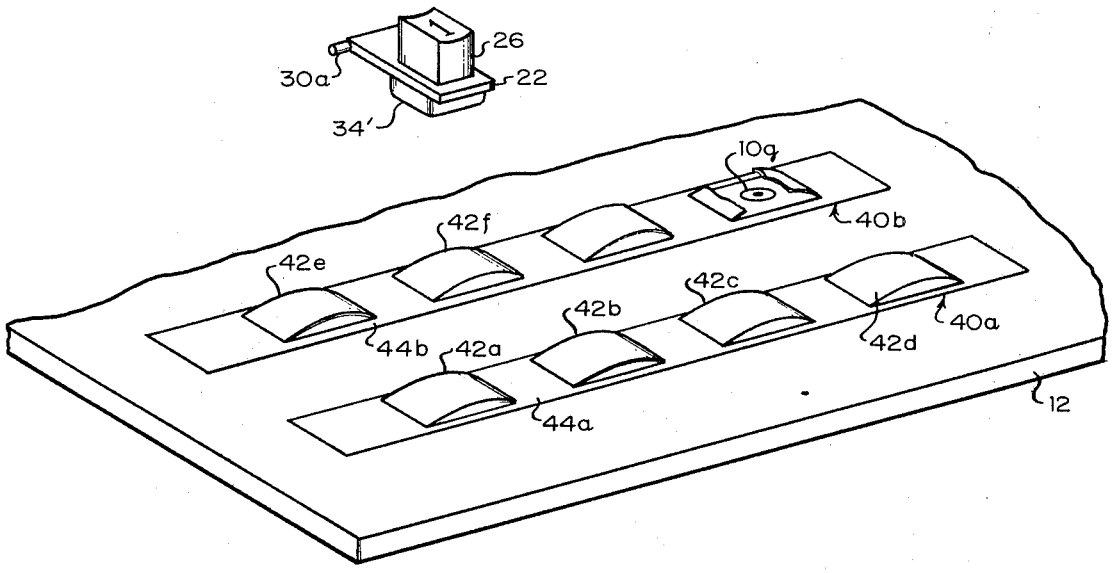
FIG. 6 shows an exploded perspective view of an alternative embodiment of the device of FIG. 4.
Figure 7A:
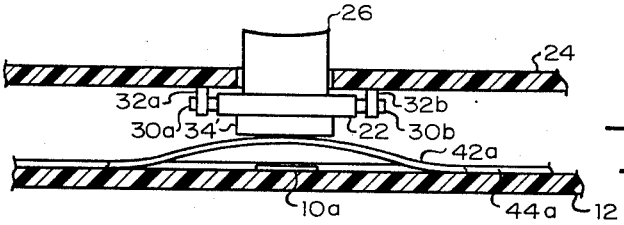
FIGS. 7 *a–c* cutaway side views of the device of FIG. 6.
Figure 7B:
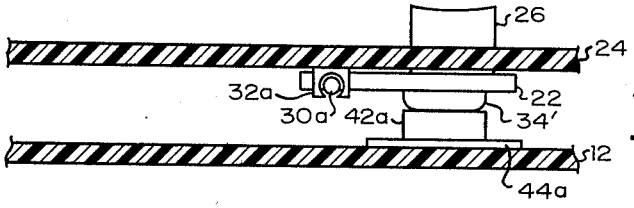
Figure 7C:
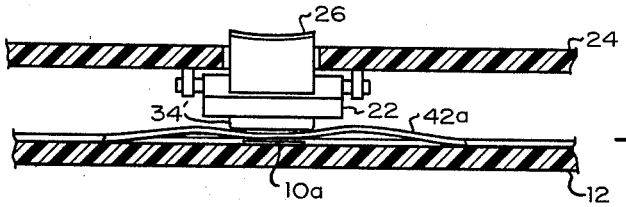

A third preferred embodiment is shown in FIGS. 6 and 7 *a–c*. As in the first embodiment, the substrate 12 supports a plurality of contacts 10. Strip assemblies 40 fastened to the substrate, comprise curved strips 42 and mounting portions 44. Strips 42 are similar to strips 15 except that they are integral with mounting portions 44. Strip assemblies 40 may be formed from a single piece of material by a process such as stamping. Mounting portions 44 are fastened to substrate 12, by soldering to printed circuit pads, for example. This method of fastening strips 42 to substrate 12 is more easily repeatable under production conditions than the method shown in FIG. 4. The operation of the switching element, illustrated in FIGS. 7 *a–c*, is essentially the same as described for the second embodiment. Depression of key 22 deflects strip 42*a* toward conductor 10*a*. As the strip flattens out it changes resilience, providing tactile feedback and making contact with the conductor.

Figure 8:
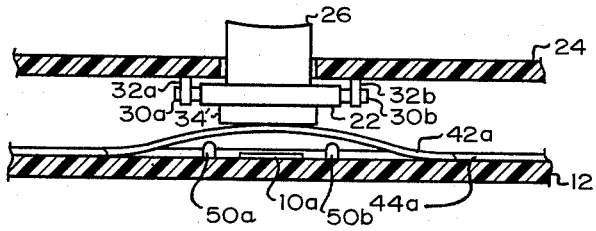
FIG. 8 shows a cutaway side view of an alternative embodiment of the device of FIG. 6.
Figure 9:
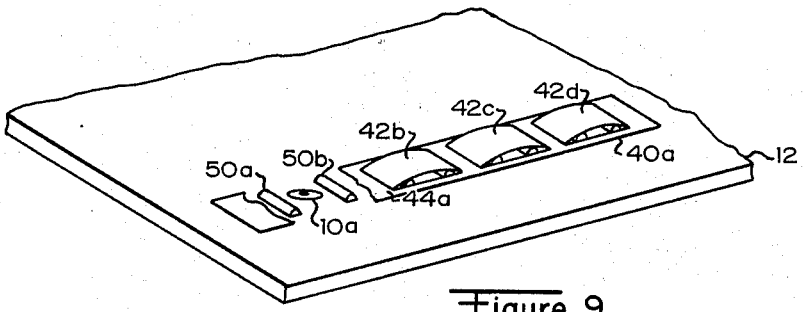
FIG. 9 shows a perspective view of a portion of FIG. 8.

FIGS. 8 and 9 illustrate a slight modification of the embodiment discussed above in connection with FIGS. 6 and 7. Protrusions 50*a* and 50*b* are attached to substrate 12 on either side of conductor 10*a*. When key 22 deflects strip 42*a* toward conductor 10*a*, protrusions 50*a* and 50*b* help insure that the strip will buckle in the middle and not off to one side. If protrusions 50*a* and 50*b* are omitted and the key is not centered over the curvature of the strip, the strip may buckle asymmetrically when deflected and fail to make contact with conductor 10*a*. In addition, protrusions 50*a* and 50*b* help insure repeatability and uniformity of the tactile feedback. Strips 42 may also be flattened slightly at the mid-portion of their curvature to help them buckle symmetrically when deflected.

An additional trade off in the selection of the configuration of key 22 is the relation of the shape of protrusion 34 to the repeatability of the tactile feedback. In FIG. 7 protrusion 34′ is illustrated as much larger than protrusion 34 of previous figures. The broad flat surface of protrusion 34′ insures a more symmetrical and repeatable buckling of strip 42*a*.

The embodiments herein described can also be used to actuate non-contacting type keyboards such as the one described in copending U.S. Pat. application Ser. No. 74,949 entitled Non-Contacting Keyboard by DAvid S. Cochran and Glenn E. McGhee, assigned to the assignor of the present invention. Additionally, the strips 14, 15 or 42 can be used to connect pairs of contacts on the substrates.

We claim:

1. In a keyboard switch assembly including a push button manually actuable from an inactive to a switch-actuating position, and a conductive switch member including a resilient element actuated by said push button from a normal to a deflected position and resiliently returning to its normal position upon removal of force from said push button, the improvement comprising an insulative board having opposite surfaces, one only of said surfaces having first and second elongated conductors thereon, said first conductor including a first switch terminal portion and said second conductor including a second switch terminal portion, said conductors and terminal portions being generally coplanar, said switch element being positioned in facing relationship with said one surface and said conductors, said switch element having first and second spaced contact areas thereon, said first contact area engaging said first terminal portion, said second contact area being in registry with said second terminal portion and engaging the same when said element is in said deflected position thereby electrically connecting said first and second terminal portions, and means for holding said push button, switch member and board in operative relationship.

2. The assembly of claim 1 wherein a section of at least said second conductor extends under said element from a location on said one surface remote therefrom.

3. As assembly as in claim 1 further comprising a first and second protrusion from said one surface on opposite sides of said second switch terminal portion for coacting with said switch element when said element is in said deflected position for ensuring contact between said second switch terminal portion and said second contact area.

* * * * *